US010655799B2

(12) United States Patent
Joye et al.

(10) Patent No.: US 10,655,799 B2
(45) Date of Patent: May 19, 2020

(54) OPTICAL DEVICE ALIGNMENT AND IDENTIFICATION

(71) Applicant: AURORALIGHT, INC., Carlsbad, CA (US)

(72) Inventors: Michael Joye, Carlsbad, CA (US); John Hradnansky, Carlsbad, CA (US)

(73) Assignee: AURORALIGHT INC., Carlsbad, CA (US)

( * ) Notice: Subject to any disclaimer, the term of this patent is extended or adjusted under 35 U.S.C. 154(b) by 0 days.

(21) Appl. No.: 16/052,800

(22) Filed: Aug. 2, 2018

(65) Prior Publication Data

US 2019/0041010 A1 Feb. 7, 2019

Related U.S. Application Data

(60) Provisional application No. 62/540,205, filed on Aug. 2, 2017.

(51) Int. Cl.

| | |
|---|---|
| ***F21K 9/60*** | (2016.01) |
| ***F21V 21/00*** | (2006.01) |
| ***F21V 5/04*** | (2006.01) |
| ***F21V 17/00*** | (2006.01) |
| *F21V 17/10* | (2006.01) |
| *F21Y 115/10* | (2016.01) |
| *F21Y 105/10* | (2016.01) |

(52) U.S. Cl.

CPC ..... *F21K 9/60* (2016.08); *F21V 5/04* (2013.01); *F21V 17/005* (2013.01); *F21V 21/00* (2013.01); *F21V 17/10* (2013.01); *F21Y 2105/10* (2016.08); *F21Y 2115/10* (2016.08)

(58) Field of Classification Search

CPC ... F21K 9/60; F21V 5/04; F21V 21/00; F21V 17/005; F21V 17/10; F21Y 2105/10; F21Y 2115/10

USPC ..... 362/257

See application file for complete search history.

(56) References Cited

U.S. PATENT DOCUMENTS

2014/0049972 A1* 2/2014 McGuire ..... F21V 21/00 362/427

* cited by examiner

*Primary Examiner* — Anh T Mai
*Assistant Examiner* — Hana S Featherly
(74) *Attorney, Agent, or Firm* — Cermak Nakajima & McGowan LLP; Malcolm K. McGowan

(57) ABSTRACT

An LED module of a lighting device includes an optic that includes one or more internal lenses, which are to be rotationally aligned with corresponding LEDs held within the module. In order to correctly rotationally align the LEDs with the lenses, the module includes one or more notches in the end of the module, which line up with and receive corresponding detents formed on the exterior surface of the optic. When the optic is mounted in the module with the detents in the notches, the LEDs line up with the lenses. Additionally, the side surface of the optic includes indicia indicating a characteristic of the optic, e.g., the lens' angles.

5 Claims, 5 Drawing Sheets

OPTICAL DEVICE ALIGNMENT AND IDENTIFICATION

This application claims priority under 35 U.S.C. 119 to U.S. Provisional App. No. 62/540,205, filed 2 Aug. 2017, the entirety of which is incorporated by reference herein.

BACKGROUND

Field of Endeavor

The present invention relates to devices, systems, and processes useful in the construction of optical lighting devices.

Brief Description of the Related Art

Alignment of the optic with the underlying light source, e.g., the LED chip of a lighting device, has proved to be problematic when there are more than one LEDs. More specifically, when there is only a single LED underlying the 'optic', that is, the (preferably) optically clear element through which the light from the LED travels to exit the device, and which optionally includes one or more lenses to focus or disperse that light, the LED is most often centered on the axis of the optic. Because such optics are most often rotationally symmetrical about that axis, physically aligning the LED with the axis, regardless of the rotational orientation of the optic relative to the axis, was not a concern, because they would automatically align, so long as the LED was physically positioned in its holder where the optic's axis intersected that holder.

When there are more than one light source (LED), alignment problems can occur. For lighting devices that include more than one light source, the light sources are physically spaced apart adjacent to each other in the device, for which the overlying optic often includes a separate lens for each light source. Alignment of each of those lenses with one of the underlying LEDs thus becomes important; without correct alignment, the light from the LED is not focused or dispersed as the device was designed. The rotational alignment of the optic, with its multiple, adjacent lenses, relative to the underlying LEDs, thus becomes troublesome in the assembly process of the lighting device, both when initially making the device, and whenever the device must be reassembled for cleaning, repair, and the like.

When assembling the optic with its holder, it is often the case that different optics can be used in the same holder. While those formed of different materials, e.g., having different colors, pose little problem when differentiating among them, when the characteristic of the optics which differentiates them from each other is less apparent, problems can arise. For example, for a lighting device that has an optic of a particular size, there can be several different versions of that optic which have lenses with different light dispersal angles. Without some identifying indicia, differentiating one version of the optic from another, based solely on the dispersal angles of their internal lenses, can be very challenging.

BRIEF DESCRIPTION OF THE DRAWINGS

The invention of the present application will now be described in more detail with reference to exemplary embodiments of the apparatus and method, given only by way of example, and with reference to the accompanying drawings, in which.

DETAILED DESCRIPTION OF EXEMPLARY EMBODIMENTS

Figure 1:
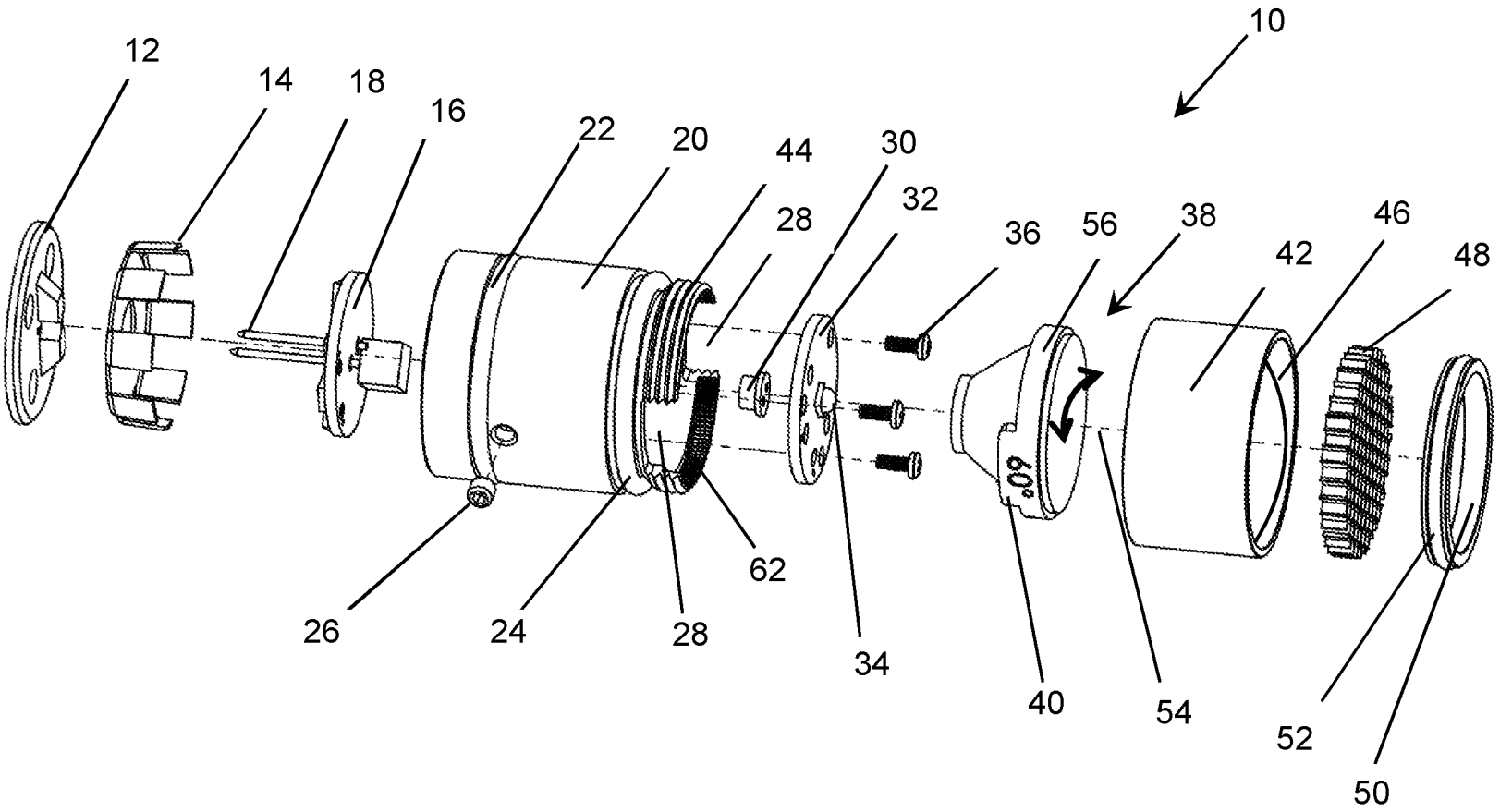
FIG. 1 illustrates an exploded perspective view of an exemplary lighting module.

Referring to the drawing figures, like reference numerals designate identical or corresponding elements throughout the several figures.

The singular forms "a," "an," and "the" include plural referents unless the context clearly dictates otherwise. Thus, for example, reference to "a solvent" includes reference to one or more of such solvents, and reference to "the dispersant" includes reference to one or more of such dispersants.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited.

For example, a range of 1 to 5 should be interpreted to include not only the explicitly recited limits of 1 and 5, but also to include individual values such as 2, 2.7, 3.6, 4.2, and sub-ranges such as 1-2.5, 1.8-3.2, 2.6-4.9, etc. This interpretation should apply regardless of the breadth of the range or the characteristic being described, and also applies to open-ended ranges reciting only one end point, such as "greater than 25," or "less than 10."

With reference to FIG. 1, from left to right in that drawing:

10 Lighting Fixture Module
12 Module Cap (e.g., plastic)
14 Driver Housing (or retainer or holder or carrier, optional)
16 Driver (with electrical pins 18; also including electronic driver components)
20 Module Body (including O-rings 22, 24, and alignment set screw 26, both used for aligning the module and its pins within the light fixture)
28 Alignment notch(es) in module body 20
30 Grommet (for passing the wires from the driver to the LED board)
32 LED board (with LED 34 mounted)
34 LED(s)
36 Mounting fasteners (screws)
38 Optic/lens (e.g., from silicone)
40 Optic alignment detent
42 Module cap (to retain the optic/lens and provide a water-resistant seal against the optic)
44 external threads
46 internal seating edge
48 Optical diffusing media (optional)
50 media retainer ring (optional, with O-ring 52)
54 center axis of optic 38
56 Outer ring of optic 38 (see FIGS. 3, 4)

58 Lens(es) of optic 38 (see FIG. 3)
60 Visual indicia (see FIGS. 3, 4)
62 High-friction surface
64 External surface of frustoconical optic
66 Gap Not shown: potting material used to pot the driver and its components, providing a thermal pathway to the module body; wires connecting the driver to the LED board 32

The optics/lens(es) 38 are advantageously optically clear, and are preferably formed of silicone, acrylic, or polycarbonate; from among these materials, silicone is preferred for its added ability to help seal the module. As discussed in greater detail below, it is particularly advantageous that the specific material chosen for the optic 38, in addition to its clarity to visible light, has a modulus of elasticity that is sufficiently high that the detent 40 will not flex when it bears on the alignment notch 28, when the module 10 is assembled and tightened.

With reference to FIG. 1, the module body 20 includes at least one, and optionally two or more, open notches 28 formed at the end of the cylindrical body. When the body 20 includes threads 44, which cooperate with threads on the inner surface of the module cap 42, to secure the module cap 42 to the module body 20, the notch(es) 28 can be formed to interrupt the threads, or the threads can be located along axis 54 further away from the optic 38, and thus can be made complete. The cap 42 also can be provided with an internal lip or edge 46 against which the optic 38 seats and is held in place, and with which the optic can form a seal.

Figure 3A:
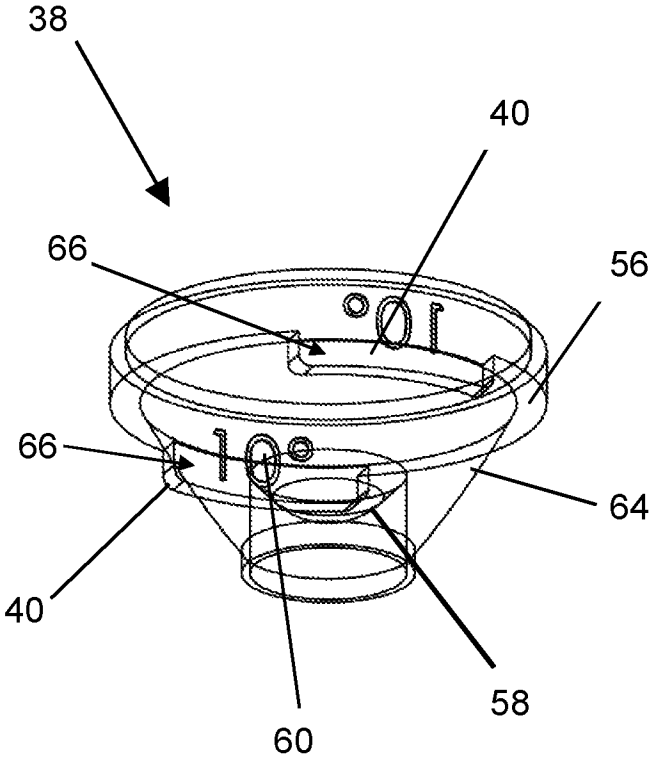
FIG. 3A illustrates a first exemplary optic.
Figures 4A, 4B, 4C:
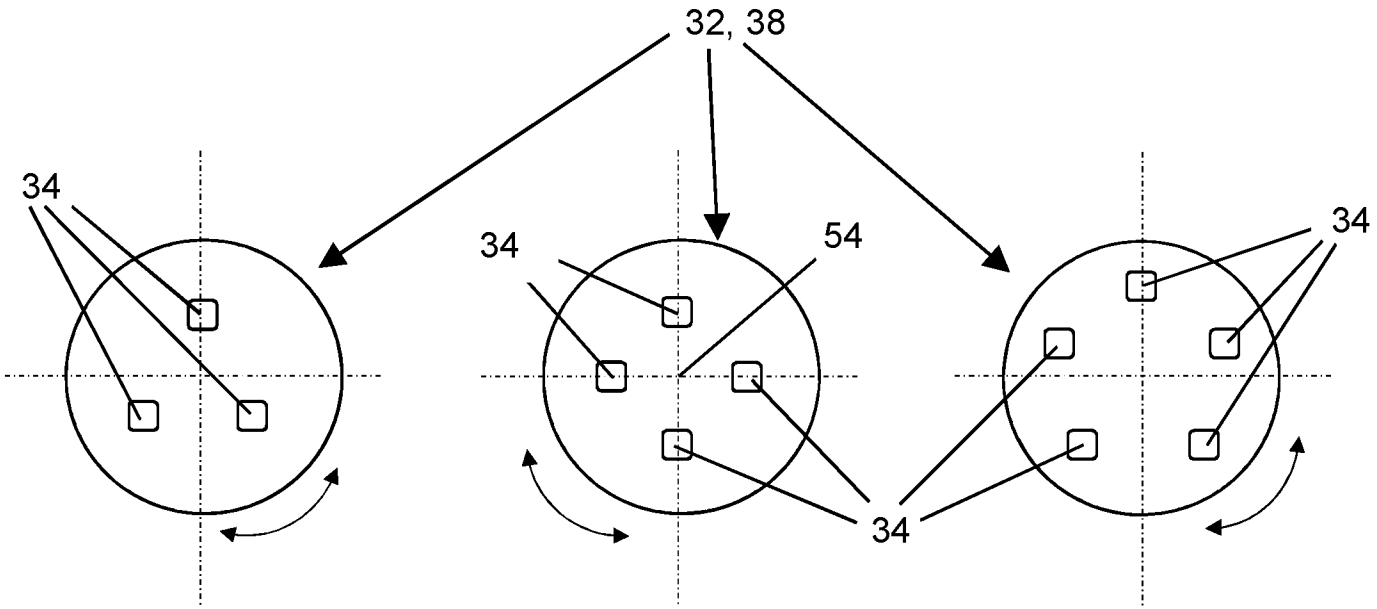
FIGS. 4A-C illustrate top plan views of boards including different numbers of LEDs.

The exemplary embodiment of FIG. 1 shows the board 32 including only a single LED chip 34, which is centered on the axis 54, and thus naturally aligns with the single lens 58 (see, e.g., FIG. 3A) of the optic 38. When the board 32 includes two or more LED chips 34 (see FIGS. 4A-C, showing embodiments of 3-, 4-, and 5-chip boards, and correspondingly 3-, 4-, and 5-lens optics), they are distributed over the same surface of the board, typically (although not necessarily) in a regular pattern. For such multiple-LED devices, the optic 38 is provided with at least the corresponding number of lenses 58, which are pre-formed into the optic 38 in the same pattern as the pattern of the placement of the LEDs on the board 32. Therefore, as discussed above, because of the rotational symmetry of the optic 38 in prior devices, rotation (see the double arrow-ended line indicting the direction of rotation) about the axis 54 becomes vital to alignment of each of the LEDs to a lens of the optic.

Figure 3B:
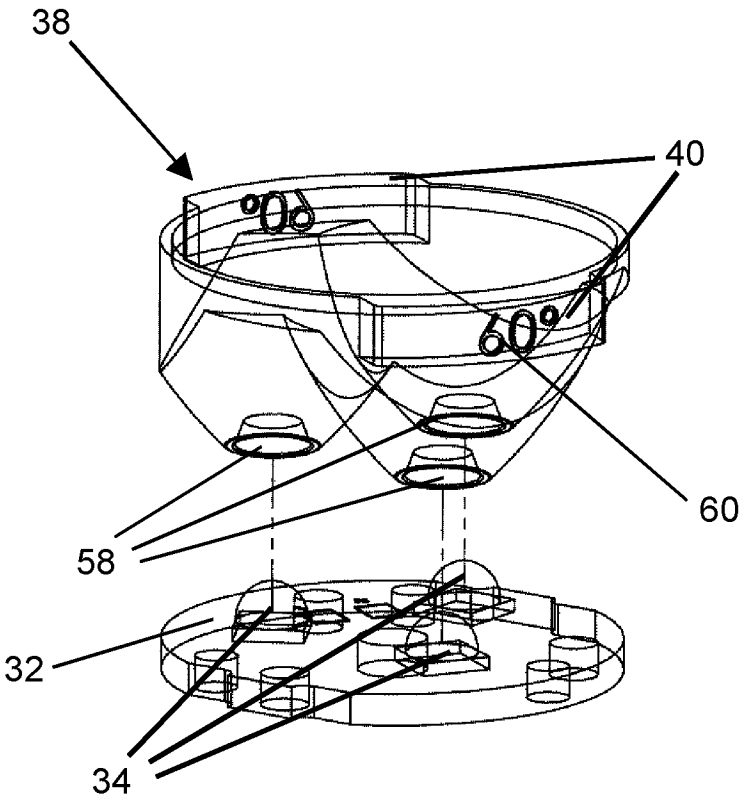
FIG. 3B illustrates a second exemplary optic.

The optic is thus provided with at least one detent, protrusion, thumb, or the like 40, which includes a protruding end which has the same size and shape as the notch(es) 28. In this way, when the optic 38 is set in place in the body 20, with its outer ring 56 abutting against the outer (rightmost, in FIG. 1) edge of the body 20, at least portions of the detent(s) 40 extend into and snuggly seat in the notch(es) 28. Because the detents and notches are dimensioned in their circumferential direction to be the same size, the optic 38, when thus seated, is prevented from rotating relative to the body 20 about the axis 54. The detent(s) 40 are formed at circumferential position(s) in the optic 38 so that the lenses 58 of the optic 38 will align with the LEDs 34 on the board 32 when held in the body 20, as indicated in FIG. 3B and suggested in FIGS. 4A-C. Not illustrated is the portion of the module into which the set screws 36 mount the board 32, which fixes the axial (54) and rotational (double ended arrow) positions of the board, and thus its LEDs, relative to the body 20.

The detents 40 strictly don't have to be provided in the same number as the number of notches 28. For example, for a board 32 having four (4) symmetrically, rotationally distributed LEDs 34 (FIG. 4B), it would be sufficient to have a single detent 40, and anywhere from one to four symmetrically, rotationally distributed notches 28; this is because each of the four corresponding lenses in the optic 38, which are also symmetrically, rotationally distributed in the optic, would line up with an LED (albeit, a different one) when the single detent were seated in each of the four detents. The same logic can be applied to other numbers of notches and detents. Clearly, though, there cannot be more detents than notches, or there would not be a notch to receive the extra detent(s), and the optic could not be mounted to the body 20; that is, there must be at least as many notches as detents.

Additionally, the detent(s) 40 do not strictly need to be the exact same shape as the notch(es) 28, or the exact same shape as each other. In other embodiments, the detent(s) can include radiused, sloped, or curved corners, such as illustrated in FIG. 3A, while the corresponding location of a notch 28 can be square. As long as each detent 40 includes a portion the circumferential length of which is the same as that of the notch 28 into which it is to be seated, the notch will secure the detent, and thus the optic 38, against rotation about the axis. In the illustrated examples, the detents 40 are 'rectangular,' but can also be purely 'square' (not accounting for their curvature).

According to yet further embodiments, the body and the optic have non-circular cross-sections. While any non-circular shape is usable, rectangles and regular polygons (triangle, square, pentagon, hexagon, and so forth) can also be used to align the lens(es) of the optic with the LED chips. With the inclusion of the notch(es) and detent(s) described herein, the correct relative rotational orientation of the optic to the underlying board and its LEDs can be dictated, from among the finite number of orientations possible with these non-circular shapes. By way of non-limiting example, when the body and the external periphery of the optic are formed as squares, so that the optic fits inside the body as described herein, and when the optic includes three lenses, the rotational orientation of the optic relative to the body which correctly aligns the LED chips to the lenses is achieved only when the detent is aligned with, and inserted into, the notch. Those of skill in the art will immediately appreciate that, for different polygons and different numbers of lenses, the permutations thereof may permit more than one rotational orientation which will result in correct lens-chip alignment, and thus more than one notch, and more than one detent, can still be used.

The inner surface of the rightmore (in FIG. 1) end of the body 20 can optionally be provided with a high friction surface 62, such as knurling, longitudinal ridges, or the like. The surface 62 bears against the outer surface of a circumferential ring or flange 56 of the optic 38 when assembled together, and inhibits, and preferably prevents, rotation of the optic 38 relative to the body 20 as they are screwed together. Making the optic 38 from softer, lower durometer material (e.g., less than 80) can serve to allow the optic 38, if properly sized, to deform slightly into the knurled or ridged surface, further securing the optic 38 inside the module body 20. Thus, a balance is struck in the selection of the material for the optic 38, between the need for rigidity so the detent(s) do not easily flex out of the notch(es) 28, and softness so the exterior surface 56 of the optic better engages with, and is held by, the high friction surface 62. As discussed elsewhere herein, a durometer of the material is advantageously between 70-80 (Shore A).

Figure 2C:
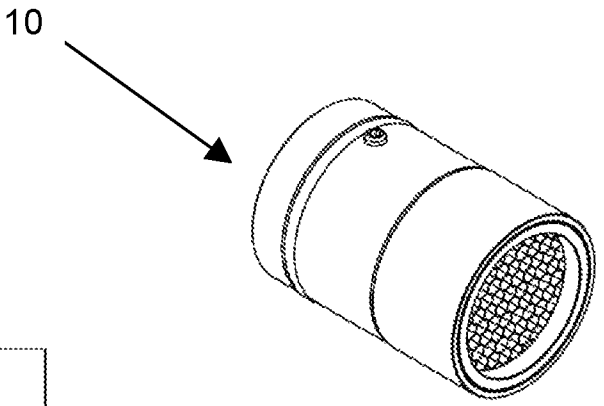
FIGS. 2A-C illustrate three different views of the module of FIG. 1, assembled.
Figure 2B:
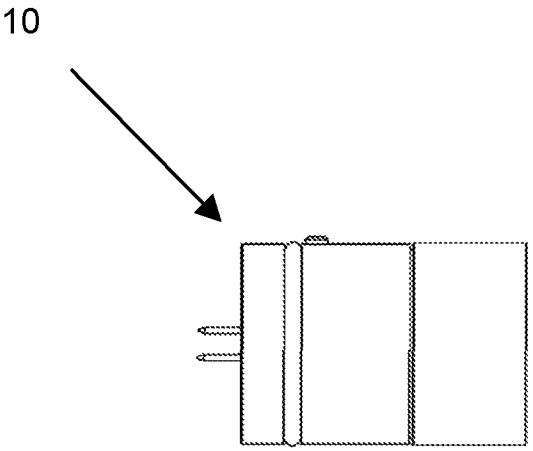
Figure 2A:
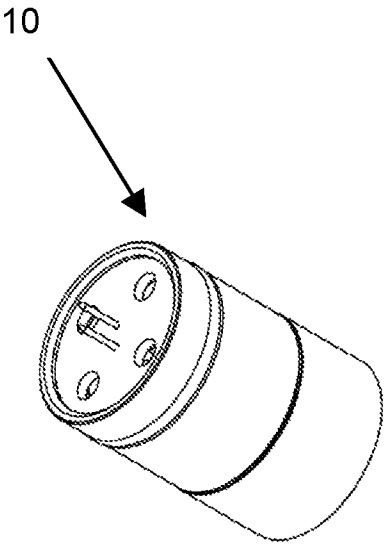

FIGS. 2A-C illustrate three views of the assembled lighting module 10.

FIG. 3A illustrates an exemplary optic 38, with only a single lens 58. As discussed elsewhere herein, the optic 38 can be alternatively formed with multiple lenses 58; FIG. 3B illustrates an optic 38 having three lenses 58. The number of lenses is advantageously the same as, but can be more than, the number of LEDs 34. FIGS. 3A-B also illustrate that the optic includes visual indicia 60 printed on the outer surface or formed in the outer ring 56 of the optic 38, more preferably on the external surface of the one or more detent(s) 40. As discussed above, visual identification of a characteristic of an optic 38, such as the angle of the lens 58, is extremely difficult. The indicia 60 is selected so that a person or machine can readily see (scan) the side of the optic and know what is the, e.g., lens angle of the optic. Locating the indicia 60 on the side surface of the ring 56, through which little or no usable light passes, is advantageous, because indicia located on the top surface (in the orientation of FIGS. 3A-B) would distort and obscure light passing through the optic, degrading its usefulness. While it is particularly useful when the indicia 60 is the lens angle itself, written numerically, the indicia can also be a code, barcode, or other symbol, which relates to another characteristic of the optic, such as its size, model number, color, opacity, material, and the like. Thus, a set of otherwise identical optics 38, which differ from each other only in the particular characteristic of interest, e.g., lens angle of the lenses in each, includes indicia 60 which indicate those different, e.g., lens angles, and thus permits ready differentiation between the otherwise identical optics.

Figure 3C:
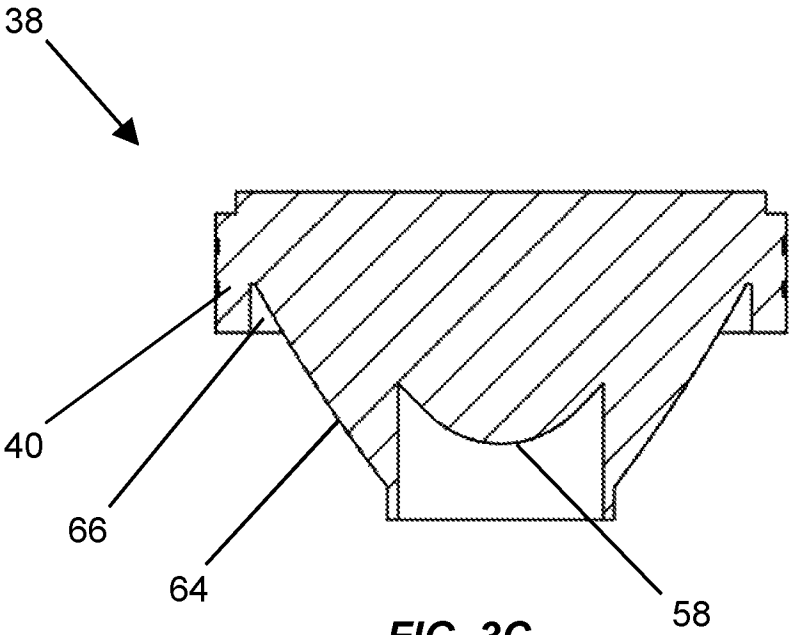
FIG. 3C illustrates a cross-sectional view of the optic of FIG. 3A, taken at line C-C in FIG. 3D.
Figure 3D:
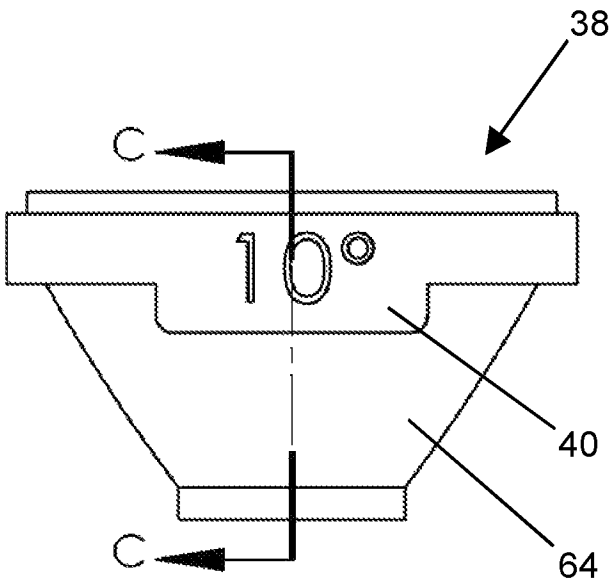
FIG. 3D illustrates a side elevational view of the optic of FIG. 3A.

With continued reference to FIGS. 3A-D, it is particularly advantageous when the detent 40 is spaced from the (frusto-) conical outer surface 64 of the optic 38, and thus forms a gap 66 between the detent and the exterior surface of the optic (see FIGS. 3A, 3C). Applicant has found that when the detent 40 is not cantilevered or otherwise separated from the outer surface 64 (i.e., when additional material of the optic bridges or completely fills the gap 66, which is a non-preferred embodiment), light originating at the one or more LEDs passing through the optic 38 is adversely affected by material of the optic that otherwise would join the detent to the outer surface 64. By eliminating that extra material, and thus forming a circumferential gap 66, light passing through the optic 38 is not diverted and results in optically more uniform light output. By eliminating that extra material, however, the detent(s) is (are) not supported as much, and is (are) thus more able to flex out of the alignment notch(es) 28 in module body 20. As discussed above, selection of a material with has the necessary optical properties, but with an increased modulus of elasticity to inhibit, or prevent, the detent from flexing out of the notch(es) when assembled together, is particularly useful. By way of example and not by way of limitation, a silicone material of durometer 70 or higher (on the Shore A scale) has been found to be particularly suitable.

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A lighting module comprising:

a body including a hollow interior, and first and second ends, wherein at least one notch is formed in said first end;

an optic including at least one detent, the detent being positioned on an exterior surface of the optic and sized to be received in said notch when the optic is positioned at least partially in the hollow interior;

wherein the notch and detent together align the optic relative to the body.

2. A lighting module according to claim 1, wherein the optic is made from material with durometer greater than 70.

3. A lighting module according to claim 1, wherein the optic is made from material with durometer less than 80.

4. A lighting module according to claim 1, wherein said body comprises a high-friction inside edge that interfaces with the optic.

5. A lighting module according to claim 1, wherein the optic comprises a frustoconical outer surface, and further comprising:

a gap between the at least one detent and the frustoconical outer surface of the optic.

* * * * *